US012091835B2

(12) United States Patent
Velde et al.

(10) Patent No.: US 12,091,835 B2
(45) Date of Patent: Sep. 17, 2024

(54) WORK VEHICLE IMPLEMENT JOINT ORIENTATION SYSTEM AND METHOD

(71) Applicant: Deere & Company, Moline, IL (US)

(72) Inventors: Todd F. Velde, Dubuque, IA (US); Michael G. Kean, Maquoketa, IA (US)

(73) Assignee: DEERE & COMPANY, Moline, IL (US)

( * ) Notice: Subject to any disclaimer, the term of this patent is extended or adjusted under 35 U.S.C. 154(b) by 361 days.

(21) Appl. No.: 17/509,701

(22) Filed: Oct. 25, 2021

(65) Prior Publication Data

US 2023/0129397 A1 Apr. 27, 2023

(51) Int. Cl.

| | |
|---|---|
| ***E02F 3/00*** | (2006.01) |
| ***E02F 3/36*** | (2006.01) |
| ***E02F 3/84*** | (2006.01) |
| ***E02F 9/26*** | (2006.01) |

(52) U.S. Cl.

CPC ..... *E02F 3/845* (2013.01); *E02F 3/3677* (2013.01); *E02F 9/265* (2013.01)

(58) Field of Classification Search

CPC ..... E02F 3/845; E02F 3/3677; E02F 9/265; E02F 3/7631; E02F 9/264; B60W 2300/17

USPC ..... 701/50

See application file for complete search history.

(56) References Cited

U.S. PATENT DOCUMENTS

| | | | | |
|---|---|---|---|---|
| 8,145,391 | B2 | 3/2012 | Omelchenko et al. | |
| 8,915,308 | B2 | 12/2014 | Joergensen et al. | |
| 9,988,787 | B1 | 6/2018 | Wang et al. | |
| 10,968,606 | B2 | 4/2021 | Green | |
| 2016/0332681 | A1* | 11/2016 | Missotten | B62D 55/112 |
| 2017/0114528 | A1* | 4/2017 | Kosarev | E02F 9/265 |
| 2018/0372498 | A1* | 12/2018 | Nackers | E02F 3/434 |
| 2018/0373966 | A1* | 12/2018 | Beschorner | G01C 21/10 |
| 2019/0242687 | A1* | 8/2019 | Alam | G06F 17/16 |
| 2020/0087887 | A1* | 3/2020 | Kean | E02F 9/006 |

(Continued)

FOREIGN PATENT DOCUMENTS

DE 102021100324 A1 7/2021

OTHER PUBLICATIONS

German Search Report issued in application No. DE102022209344.5 dated May 22, 2023 (10 pages).

(Continued)

*Primary Examiner* — Shardul D Patel

(74) *Attorney, Agent, or Firm* — KLINTWORTH & ROZENBLAT IP LLP

(57) ABSTRACT

A joint orientation system is provided for a work vehicle having a chassis and an implement coupled to the chassis at a joint. The joint orientation system includes a first IMU positioned on a first side of the work vehicle relative to the joint and configured to collect a first IMU acceleration and a first IMU angular velocity and a second IMU positioned on a second side relative to the joint and configured to collect a second acceleration and a second angular velocity of the implement. A controller is configured to receive the first and second IMU accelerations and the first and second IMU angular velocities; determine a joint orientation correction based on IMU accelerations and IMU angular velocities; modify an estimate of joint orientation with the joint orientation correction to generate a current joint orientation; and output the current joint orientation for actuation of the implement.

13 Claims, 4 Drawing Sheets

(56) References Cited

U.S. PATENT DOCUMENTS

| | | | | |
|---|---|---|---|---|
| 2021/0156110 | A1* | 5/2021 | Ishihara | E02F 3/844 |
| 2021/0215483 | A1* | 7/2021 | Krone | G01C 21/165 |

OTHER PUBLICATIONS

Wikipedia, Newton's Method, https://en.wikipedia.org/w/index.php?title=Newton%27s_method&oldid=1051152432, dated Oct. 21, 2021.

* cited by examiner

WORK VEHICLE IMPLEMENT JOINT ORIENTATION SYSTEM AND METHOD

CROSS-REFERENCE TO RELATED APPLICATION(S)

Not applicable.

STATEMENT OF FEDERALLY SPONSORED RESEARCH OR DEVELOPMENT

Not applicable.

FIELD OF THE DISCLOSURE

The present disclosure relates to a machine control arrangement of a work vehicle, particularly to an implement joint orientation system to determine the position of a work machine implement to enable generation of implement actuation commands.

BACKGROUND OF THE DISCLOSURE

A work vehicle includes one or more implements that perform various tasks. For example, a crawler dozer may include a blade that is adjustable to a selected angle for creating a flat surface at various angles, slopes, and elevations. To properly operate such implements, a work vehicle typically includes a system of various types of sensors and controllers that attempt to maintain an accurate estimation of the implement orientation in order to generate appropriate actuation commands.

SUMMARY OF THE DISCLOSURE

The disclosure provides an implement joint orientation system and method that facilitates operation of a work vehicle.

In one aspect, the disclosure provides a joint orientation system for a work vehicle having a chassis and an implement coupled to the chassis at a joint. The joint orientation system includes a first inertial measurement unit (IMU) positioned on a first side of the work vehicle relative to the joint and configured to collect a first IMU acceleration and a first IMU angular velocity; a second IMU positioned on a second side of the work vehicle relative to the joint and configured to collect a second IMU acceleration and a second IMU angular velocity; and a controller coupled to the first IMU and the second IMU. The controller includes a processor and memory architecture configured to: receive the first IMU acceleration, the first IMU angular velocity, the second IMU acceleration, and the second IMU angular velocity; determine a joint orientation correction based the first IMU acceleration, the first IMU angular velocity, the second IMU acceleration, and the second IMU angular velocity; modify an estimate of joint orientation with the joint orientation correction to generate a current joint orientation of the joint; and output the current joint orientation of the joint for actuation of the implement.

In another aspect, the disclosure provides a work vehicle with a chassis; a lift frame supported by the chassis; an implement coupled to the lift frame at a joint; at least one cylinder pivotably coupled to the implement and the chassis or the lift frame such that actuation of the at least one cylinder repositions the implement relative to at least one of the chassis and the lift frame at the joint; and a machine control arrangement. The machine control arrangement includes a first inertial measurement unit (IMU) coupled to the chassis or the lift frame and configured to collect a first IMU acceleration and a first IMU angular velocity of the chassis or the lift frame; a second IMU coupled to the implement and configured to collect a second IMU acceleration and a second IMU angular velocity of the implement; a joint orientation system; and an implement actuation system. The joint orientation system is coupled to the first IMU and the second IMU and has processing and memory architecture configured to: receive the first IMU acceleration, the first IMU angular velocity, the second IMU acceleration, and the second IMU angular velocity; determine a joint orientation correction based on the first IMU acceleration, the first IMU angular velocity, the second IMU acceleration, and the second IMU angular velocity; and modify an estimate of joint orientation with the joint orientation correction to generate a current joint orientation of the joint. The implement actuation system is coupled to the joint orientation system and the at least one cylinder and has processing and memory architecture configured to: receive operator commands from an operator and the current joint orientation from the joint orientation system; and actuate the at least one cylinder based on the current joint orientation and the operator commands.

In a further aspect, the disclosure provides a method for operating an implement of a work vehicle extending from a chassis of the work vehicle at a joint. The method includes collecting, with a first inertial measurement unit (IMU) positioned on a first side of the work vehicle relative to the joint, a first IMU acceleration and a first IMU angular velocity; collecting, with a second IMU positioned on a second side of the work vehicle relative to the joint, a second IMU acceleration and a second IMU angular velocity; determining, with a controller, a joint orientation correction based on the first IMU acceleration, the first IMU angular velocity, the second IMU acceleration, and the second IMU angular velocity; modifying, with the controller, an estimate of joint orientation with the joint orientation correction to generate a current joint orientation of the joint; and actuating the implement based on the current joint orientation.

The details of one or more embodiments are set forth in the accompanying drawings and the description below. Other features and advantages will become apparent from the description, the drawings, and the claims.

BRIEF DESCRIPTION OF THE DRAWINGS

FIG. is a top perspective view of a work vehicle as a crawler dozer according to an example embodiment.

Like reference symbols in the various drawings indicate like elements.

DETAILED DESCRIPTION

The following describes one or more example embodiments of the disclosed implement joint orientation system, method, or work vehicle, as shown in the accompanying figures of the drawings described briefly above. Various modifications to the example embodiments may be contemplated by one of skill in the art.

In the agriculture, construction, and forestry industries, work vehicles have implements and other elements that are utilized to perform tasks in various types of environments. For example, a crawler dozer may include a blade mounted to a chassis at a ball joint that is adjustable to a selected angle for manipulating material. An accurate determination of a joint orientation (or angle) facilitates operation of the blade. Other examples of work vehicles with joint mounted implements include compact tractors, loaders, graders, and the like. Various sensors, including inertial measurement units (IMUs) with accelerometers and gyroscopes, have been used to determine joint orientations. Conventional approaches may have challenges with accuracy, noise, and sensor bias. For example, when acceleration is used as a measure of gravity as an external position reference, that reference provides no indication with respect to heading or yaw.

According to the present disclosure, the work vehicle may implement a machine control arrangement with an implement joint orientation system in order to facilitate operation of the implement. As described below, the joint orientation system may incorporate at least two IMUs, one associated with the implement and one associated with the chassis or lift frame, in order to fuse the measured accelerations and angular velocities. One or more additional kinematic relationships and measurements may be used as constraints for the resulting joint orientation. In one example, the angular velocities of the IMUs may be compared to generate a change in orientation, and accelerations from the IMUs and the constraints may be used to generate an error correction in the orientation. The error correction and orientation change may be used to update the joint orientation. An attenuation may be applied to the acceleration and/or angular velocities to accommodate or otherwise improve error issues with the IMUs. The joint orientation system may implement and/or use a complimentary filter, Kalman filter, or a Newton-Raphson method to improve the determination of the joint orientation. The resulting joint orientation may be used by the machine control arrangement to operate the implement and other work vehicle systems. Additional details will be provided below.

Figure 1:
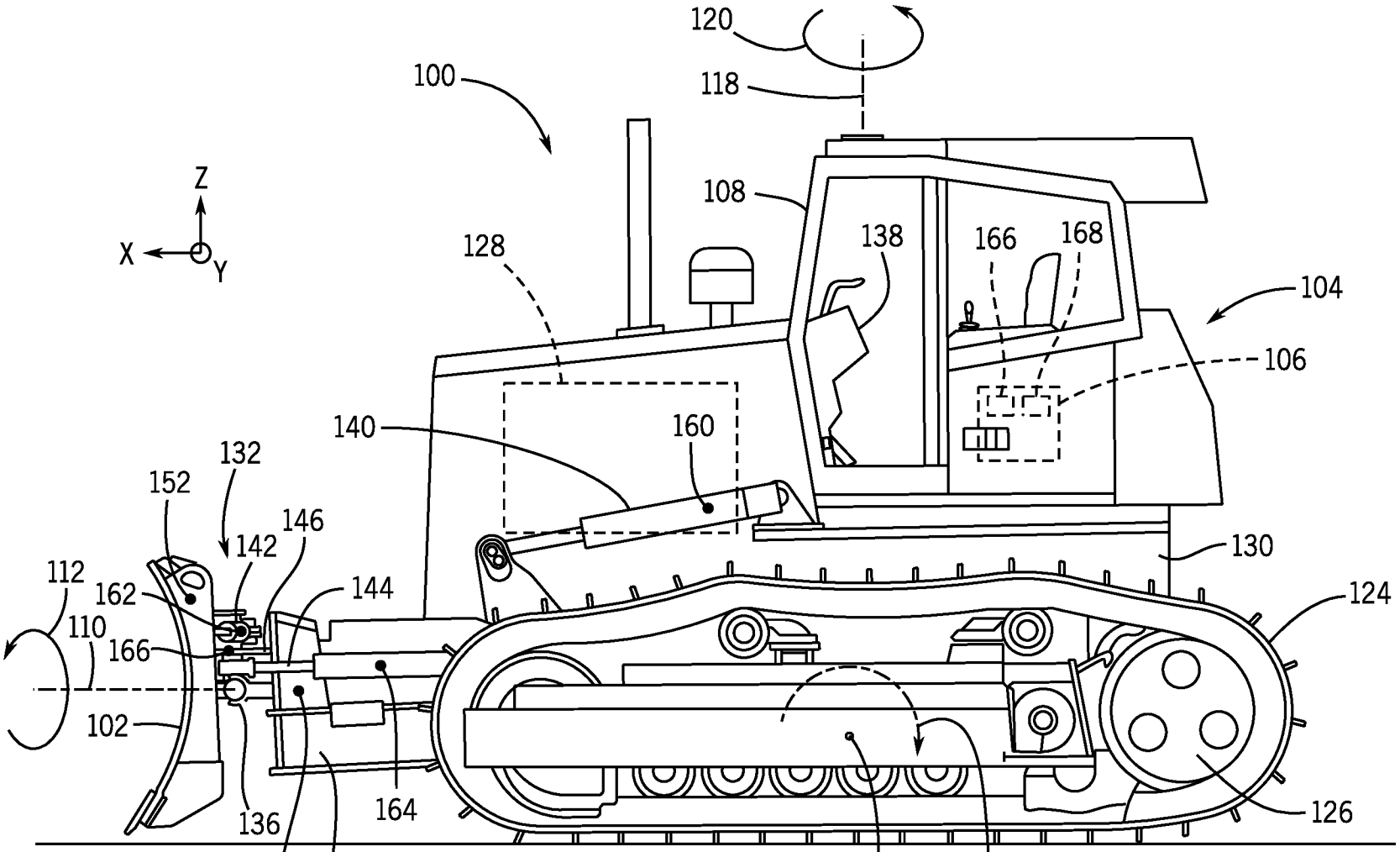

Reference is now made to FIG. 1, which is a perspective view of work vehicle 100 in which the work vehicle 100 is illustrated as a crawler dozer (also referred to as a crawler or a dozer). The embodiments discussed herein may be applicable to any work vehicle with a ground-engaging blade or work implement such as a compact track loader, motor grader, scraper, skid steer, tractor, backhoe, and excavator. As a crawler dozer, in one example, the work vehicle 100 may be operated to engage, cut, and move material to achieve simple or complex features on the ground.

As discussed in greater detail below, the work vehicle 100 includes a blade 102 as an implement to perform various tasks. The blade 102 may be operated as part of a machine control arrangement 104 implemented by a controller 106, either autonomously and/or based on commands from an operator at an operator interface 138 arranged within an operator station 108. Additional details regarding the machine control arrangement 104, particularly the mechanism by which the orientation of the blade 102 may be determined, are provided below.

As used herein, directions with regard to work vehicle 100 may be referred to from the perspective of an operator seated within the operator station 108, or as applicable, from the perspective of the respective element being discussed. Elements of the work vehicle 100 may experience movement in three directions and rotation in three directions. As referenced for the overall work vehicle 100 in FIG. 1, a longitudinal direction 110 may be considered along the length of the work vehicle 100; a lateral direction 114 may be considered from lateral side-to-side of the work vehicle 100; and a vertical direction 118 may be considered perpendicular to both the longitudinal and lateral directions 110, 114. Rotation for work vehicle 100 may be referenced as roll 112 about the longitudinal direction 110, pitch 116 about the lateral direction 114, and yaw 120 about the vertical direction 118.

In addition to the systems discussed below, the work vehicle 100 may include any suitable type of components to carry out appropriate tasks, including propulsion, steering, braking, communications, and the like. In one example, the work vehicle 100 is supported on the ground by undercarriage 122. The undercarriage 122 includes left and right tracks 124 arranged on supporting components 126 that engage the ground and provide tractive force for work vehicle 100. Supporting components 126 may include various frames and rotational components, such as idlers, rollers, sprockets, and the like.

The work vehicle 100 further includes an engine 128 that may be controlled by an operator in the operator station 108 via the operator interface 138 and/or autonomously controlled by the controller 106. As an example, the engine 128 may pressurize hydrostatic pumps to, in turn, power hydraulic motors that drive the tracks 124 via supporting components 126 to thereby control propulsion and traction for work vehicle 100. The engine 128 may also power various other systems of the work vehicle 100.

The undercarriage 122 is affixed to, and provides support and tractive effort for, a chassis or frame 130 of work vehicle 100. The chassis 130 provides structural support and rigidity to work vehicle 100. In this embodiment, chassis 130 is a weldment of multiple formed and joined steel members, but in alternative embodiments it may have any number of different materials or configurations.

As introduced above, the work vehicle 100 includes the blade 102 as a work implement that may engage to move or shape the ground or material. The blade 102 may be used to move material from one location to another and to create features on the ground, including flat areas, grades, hills, roads, or more complexly shaped features.

In this embodiment, blade 102 of work vehicle 100 may be referred to as a six-way blade, six-way adjustable blade, or power-angle-tilt blade. As discussed below, the blade 102 may be hydraulically actuated to pitch up or down (which may also be referred to as blade lift, or raise and lower), roll left or roll right (which may be referred to as blade tilt, or tilt left and tilt right), and yaw left or yaw right (which may be referred to as blade angle, or angle left and angle right). Alternative embodiments may utilize a blade with fewer hydraulically controlled degrees of freedom, such as a 4-way blade that may not be angled, or actuated in the direction of yaw 120. The blade 102 is movably connected to the chassis 130 of work vehicle 100 through a linkage 132, which supports and actuates blade 102 relative to chassis 130.

The linkage 132 may include multiple structural members to carry forces between blade 102 and the remainder of work vehicle 100 and may provide attachment points for hydraulic cylinders or links 140, 142, 144, 146 that may actuate the blade 102 in the lift, pitch, tilt, and angle directions. The linkage 132 includes a lift frame (or c-frame) 134, a structural member with a c-shape positioned rearward of blade 102 with the c-shape open toward the rear of work vehicle 100 and pivotally coupled to the chassis 130. The blade 102 is at least partially coupled to the lift frame 134 via a ball joint (or ball-socket joint) 136, thereby enabling the blade 102 three degrees of freedom in its orientation relative to lift frame 134 while still transferring rearward forces on blade 102 to the remainder of work vehicle 100.

As noted above, the blade 102 may be manipulated by actuation of a number of cylinders or links 140, 142, 144, 146. For example, the blade 102 may be raised or lowered relative to work vehicle 100 by the actuation of lift cylinders 140 (one of which is shown), which may raise and lower lift frame 134 and thus raise and lower blade 102. Although only one of the lift cylinders 140 is illustrated, the present disclosure may include two of the lift cylinders 140. For each of the lift cylinders 140, the rod end is pivotally connected to an upward projecting clevis of lift frame 134 and the head end is pivotally connected to the remainder of work vehicle 100 just below and forward of operator station 108. As such, the configuration of linkage 132 and the positioning of the pivotal connections for the head end and rod end of lift cylinders 140 enable the extension and retraction of lift cylinders 140 to respectively lower and raise the blade 102. In alternative embodiments, the blade 102 may be raised or lowered by a different mechanism, or the lift cylinders 140 may be configured differently.

As a further example, the blade 102 may be tilted relative to work vehicle 100 by the actuation of tilt cylinder 142, which may also be referred to as moving blade 102 in the direction of roll 112. For the tilt cylinder 142, the rod end is pivotally connected to a clevis positioned on the back and sides of blade 102 above the ball joint 136 between blade 102 and lift frame 134 and the head end is pivotally connected to an upward projecting portion of linkage 132. The positioning of the pivotal connections for the head end and the rod end of tilt cylinder 142 result in the extension of tilt cylinder 142 operating to tilt the blade 102 in a first direction and the retraction of tilt cylinder 142 operating to tilt the blade 102 in the other direction. In alternative embodiments, the blade 102 may be tilted by a different mechanism (e.g., an electrical or hydraulic motor) or the tilt cylinder 142 may be configured differently.

Further, the blade 102 may be angled relative to work vehicle 100 by the actuation of angle (or yaw) cylinders 144 (one of which is shown), which may also be referenced as moving the blade 102 in the direction of yaw 120. For each of the angle cylinders 144, the rod end is pivotally connected to the blade 102 while the head end is pivotally connected to the lift frame 134 such that cooperating extension and retraction enable angling (or yawing) of the blade 102 rightward or leftward. In alternative embodiments, the blade 102 may be angled by a different mechanism or the angle cylinders 144 may be configured differently.

The blade 102 may also be manipulated with a pitch link (or cylinder) 146 that sets the pitch of the blade 102 with respect to the lift cylinder 140, rotating about the ball joint 136 about the lateral direction 114. As noted, the pitch link 146 may be a link or an independently actuatable cylinder that enables an operator to pitch the blade 102.

In one example, each of lift cylinders 140, tilt cylinder 142, and angle cylinders 144 may be a double acting hydraulic cylinder. One end of each cylinder may be referred to as a head end, and the end of each cylinder opposite the head end may be referred to as a rod end. Each of the head end and the rod end may be coupled to another component, such as a through a pin-bushing or pin-bearing coupling. As a double acting hydraulic cylinder, each may exert a force in the extending or retracting direction. Directing pressurized hydraulic fluid into a head chamber of a cylinder will tend to exert a force in the extending direction, while directing pressurized hydraulic fluid into a rod chamber of a cylinder will tend to exert a force in the retracting direction. The head chamber and the rod chamber may both be located within a barrel of the respective hydraulic cylinder, and may both be part of a larger cavity which is separated by a movable piston connected to a rod of the hydraulic cylinder. The volumes of each of the head chamber and the rod chamber change with movement of the piston, while movement of the piston results in extension or retraction of the hydraulic cylinder. The movement of the piston refers to a stroke length in which each of lift cylinders 140, tilt cylinder 142, and angle cylinders 144 may move from 0% to 100% of maximum stroke. As noted below, a number of sensors 160, 162, 164 may be provided to collect data associated with the position of the cylinders 140, 142, 144. Moreover, a sensor 166 to determine the length of the pitch link 146 may also be provided.

As introduced above, the machine control arrangement 104 may be implemented by the controller 106 to operate the work vehicle 100, either automatically and/or based on operator commands. In particular, the machine control arrangement 104 may operate the blade 102, as discussed in greater detail below. The machine control arrangement 104 may particularly determine the angle or orientation of the ball joint 136 in order to generate the appropriate actuation commands for the blade 102.

In one example, the machine control arrangement 104 may include or otherwise interact with a number of sensors, including a first (or base) inertial measurement unit (IMU) 150, arranged on an element on a first (or base) side of the work vehicle 100 relative to the ball joint 136, a second (or implement) IMU 152 arranged on an element on a second (or implement) side of the work vehicle relative to the ball joint 136 opposite to the first IMU 150, and/or one or more of a lift cylinder sensor 160, a tilt cylinder sensor 162, an angle cylinder sensor 164, and/or a pitch length sensor 166. Other sensors may be provided and/or considered. For example, depending on the position of the first and second IMUs 150, 152, additional sensors may be provided at joints between intermediate components (e.g., if the first IMU 150 is positioned on chassis 130, an additional sensor(s) may be positioned proximate to the joint(s) between the chassis 130 and the elements coupling the chassis 130 to the joint 136).

In one example, the first IMU 150 may be arranged on the lift frame 134, although in other examples, the first IMU 150 may be arranged on chassis 130, as well as other positions on the base side of the joint 136 of the work vehicle 100. Additionally, the second IMU 152 may be arranged on the blade 102, although in other examples, the second IMU 152 may be arranged in other positions on the implement side of the joint 136 of the work vehicle 100. The first and second IMUs 150, 152 each include at least one accelerometer that collects information associated with the acceleration of the respective lift frame 134 or blade 102 and at least one gyroscope that collects information associated with the angular velocity of the respective life frame 134 or blade 102 for each of the three vehicle axes, e.g., relative to directions 110, 114, 118. As such, in one example, each IMU 150, 152 may be considered to include a longitudinal accelerometer, a lateral accelerometer, and a vertical accelerometer and a roll gyroscope, a pitch gyroscope, and a yaw gyroscope. The IMUs 150, 152 may output raw or conditioned sensor data to the controller 106.

In addition to the IMUs 150, 152, the sensors 160, 162, 164, 166 may collect information associated with the position of the lift cylinder 140, the tilt cylinder 142, the angle cylinder 144, and/or the pitch link 146, respectively. In one example, the sensors 2160, 162, 164, 166 may determine the current stroke or position of the respective cylinders or link 140, 142, 144, 166, although other mechanisms may be provided. As discussed below, at least portions of this sensor data may be used to determine the orientation of the joint 136 to facilitate operation of the blade 102.

As noted above, the controller 106 implements operation of the machine control arrangement 104, as well as other systems and components of the work vehicle 100, including any of the functions described herein. The controller 106 may be configured as computing devices with associated processor devices and memory architectures, as hydraulic, electrical or electro-hydraulic controllers, or otherwise. In the depicted example, the machine control arrangement 104 may be implemented within the controller 106 with processing architecture such as a processor 166 and memory 168, as well as suitable communication interfaces. For example, the controller 106 may implement functional modules or units with the processor 166 based on programs or instructions stored in memory 168. In some examples, the consideration and implementation of aspects of the machine control arrangement 104 by the controller 106 are continuous, e.g., constantly active. In other examples, the activation may be selective, e.g., enabled or disabled based on input from the operator or other considerations.

As such, the controller 106 may be configured to execute various computational and control functionality with respect to the work vehicle 100. The controller 106 may be in electronic, hydraulic, or other communication with various other systems or devices of the work vehicle 100, including via a CAN bus (not shown). For example, the controller 106 may be in electronic or hydraulic communication with various actuators, sensors, and other devices within (or outside of) the work vehicle 100.

In some embodiments, the controller 106 may be configured to receive input commands and to interface with an operator via the operator interface 138, including typical steering, acceleration, velocity, transmission, and wheel braking controls, as well as other suitable controls, such as blade control. The operator interface 138 may be configured in a variety of ways and may include one or more display devices, joysticks, various switches or levers, one or more buttons, a touchscreen interface, a keyboard, a speaker, a microphone associated with a speech recognition system, or various other human-machine interface devices.

Figure 2:
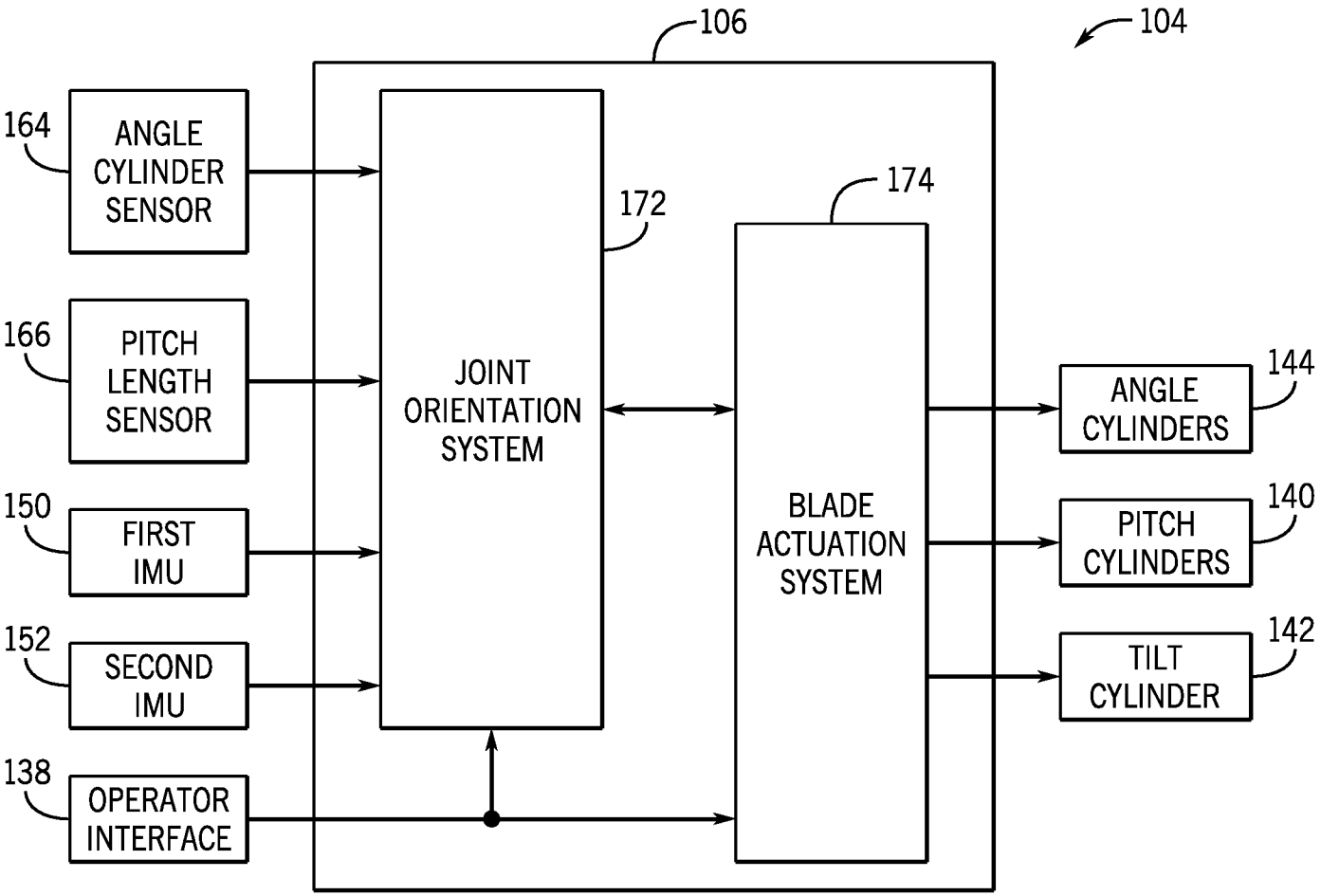
FIG. 2 is a schematic diagram with data flows of a machine control arrangement according to an example embodiment.

As introduced above, the machine control arrangement 104 functions to operate the blade 102, as discussed below with reference to FIGS. 2 and 3. Referring initially to FIG. 2, aspects of the machine control arrangement 104 may be organized within the controller 104 as one or more functional systems, units, or modules 172, 174 (e.g., software, hardware, or combinations thereof), including a joint orientation system 172 and a blade actuation system 174. As can be appreciated, the systems 172, 174 shown in FIG. 2 may be combined and/or further partitioned to carry out similar functions to those described herein.

Generally, the joint orientation system 172 receives inputs from a number of sources, including one or more of the first IMU 150, the second IMU 152, the pitch length sensor 166, the angle cylinder sensor 164, and/or the operator interface 138. As noted above, one or more of the sensors 164, 166 may be omitted, particularly if the respective sensor is not being actuated. Moreover, such input data may also come in from other systems or controllers, either internal or external to the work vehicle 100. This input data may represent any data sufficient to operate the work vehicle 100, particularly the blade 102, as described below.

During operation, the joint orientation system 172 generates a joint orientation ($\vec{\theta}$) reflecting the angle or orientation of the ball joint 136 (FIG. 1), and thus, the orientation or position of the blade 102. The blade actuation system 174 receives the joint orientation ($\vec{\theta}$) from the joint orientation system 172, as well as operator commands from the operator interface 138, and generates actuation commands for the cylinders 140, 142, 144 (e.g., for the pump and valves that actuate the cylinders 140, 142, 144). Such actuation commands may facilitate the repositioning of the cylinders 140, 142, 144 into predetermined settings that place the blade into a desired position. Of course, other mechanisms, inputs, and outputs may be provided and implemented to operate the blade 102. Additional details regarding the generation of the joint orientation ($\vec{\theta}$) are discussed below with respect to FIG. 3.

Figure 3:
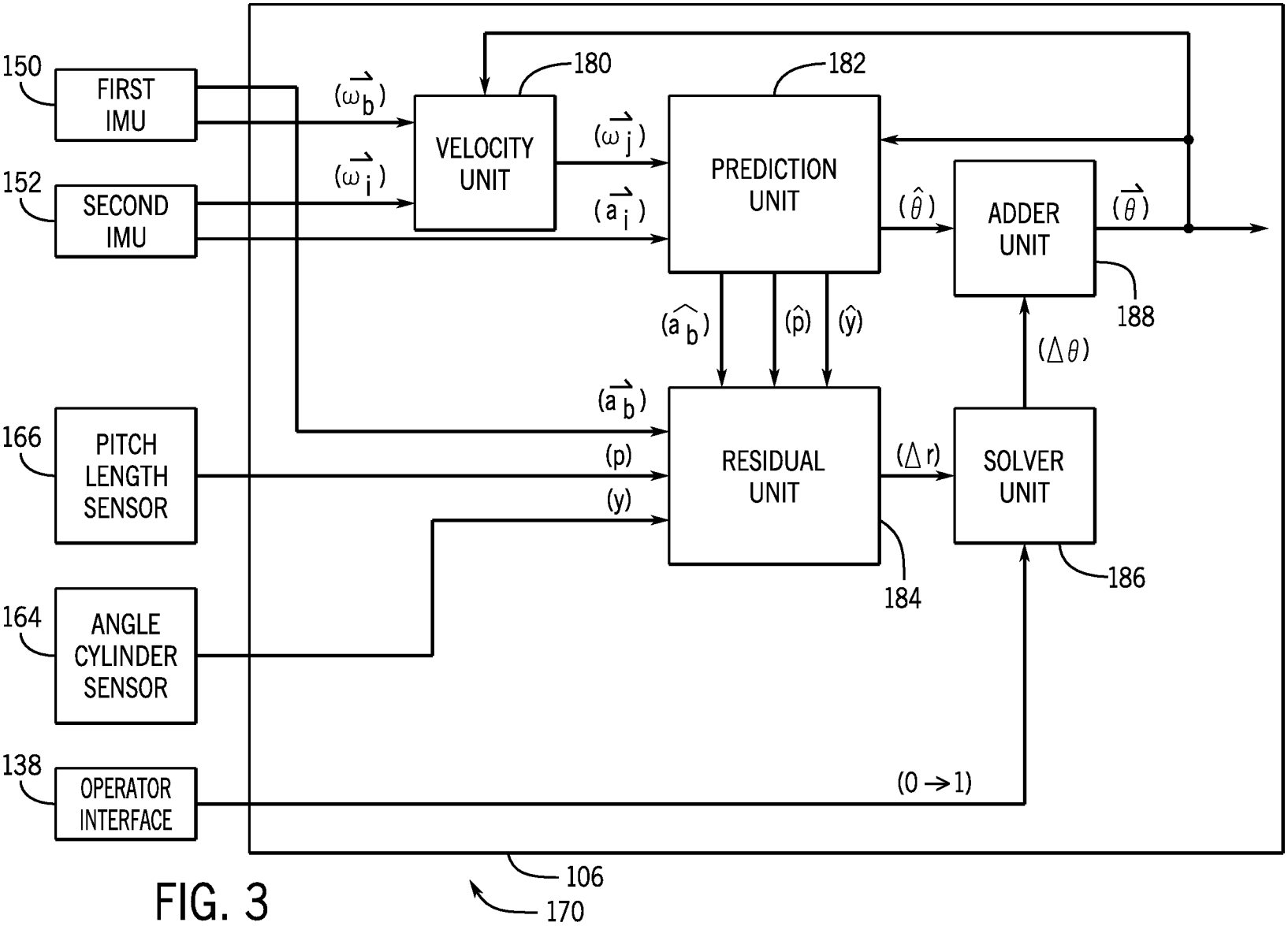
FIG. 3 is a schematic diagram with data flows of an implement joint orientation system of the machine control arrangement of FIG. 2 according to an example embodiment.

Reference is now made to FIG. 3, which is a schematic block diagram of the joint orientation system 172. As above, aspects of the joint orientation system 172 may be organized as one or more functional units or modules 180, 182, 184, 186, 188 (e.g., software, hardware, or combinations thereof). As can be appreciated, the units 180, 182, 184, 186, 188 shown in FIG. 3 may be combined and/or further partitioned to carry out similar functions to those described herein. In this example, the joint orientation system 172 may be considered to include a velocity unit 180, a prediction unit 182, a residual unit 184, a solver unit 186, and an adder unit 188. As described below, the joint orientation system 172 is configured to determine and solve a system of equations in order to generate the joint orientation ($\vec{\theta}$) based on the known fixed values (e.g., vectors with fixed magnitudes), the measured variable values (e.g., vectors with varying magnitudes that are measured), and the constraints on the system (e.g., certain vectors being fixed relative to one another). Such vectors may include first acceleration vectors (or "accelerations") ($(\vec{a}_b)$) associated with the first IMU 150 on the lift frame 136, first angular velocity vectors (or "angular velocities") ($(\vec{\omega}_b)$) associated with the first IMU 150 on the lift frame 136, second acceleration vectors (or "accelerations") ($(\vec{a}_\iota)$) associated with the second IMU 152 on the blade 102, and second angular velocity vectors (or "angular velocities") ($\vec{\omega}_\iota$) associated with the second IMU 152 on the blade 102, as well as one or more cylinder length constraints. As will be understood by a person of ordinary skill in the art, the terms "solved," "solving," and "solution" as used herein are intended include an estimated solution. For example, the solution to the system of equations may include an estimated solution based on an iterative method that converges to a theoretical solution. Operation of the joint orientation system 172 will now be discussed in greater detail.

The velocity unit 180 receives first angular velocity vector ($\vec{\omega}_b$) from the first IMU 150 (e.g., on the "base" of the vehicle 100, such as the lift frame 134) and the second angular velocity vector ($\vec{\omega}_\iota$) from the second IMU 152 (e.g., on the blade 102). Each angular velocity vector ($\vec{\omega}_b$), ($\vec{\omega}_\iota$) may be modified as necessary to reflect a common frame of reference, such relative to earth or a first body (e.g., the lift frame 134 or the joint 136) frame of reference, based a reference physical relationship between the two IMUs 150, 152. In one example, the second angular velocity vector ($\vec{\omega}_\iota$) may be multiplied by an implement rotation matrix representing the physical relationship between the blade 102 and the lift frame 134 such that the second angular velocity vector ($\vec{\omega}_\iota$) is expressed in the same coordinate system as the first angular velocity vector ($\vec{\omega}_b$). The velocity unit 180 considers the velocity vectors ($\vec{\omega}_b$), ($\vec{\omega}_\iota$) with respect to the joint orientation the joint orientation ($\vec{\theta}$) in order to resolve one or both of the velocity vectors ($\vec{\omega}_b$), ($\vec{\omega}_\iota$) in a common frame of reference and with respect to a particular time step or period ($\Delta_t$) such that the difference between the first and second angular velocities over the time period ($\Delta_t$) yields a measured change in joint angular velocity or the relative joint angular velocity vector ($\vec{\omega}_j$).

Generally, the prediction unit 182 receives a measured acceleration vector ($\vec{a}_\iota$) from the second IMU 152 (e.g., on the blade 102 as the implement) as well as the joint angular velocity vector ($\vec{\omega}_j$) from the velocity unit 180. The prediction unit 182 may also receive the most recently generated joint orientation ($\vec{\theta}$). In one example, the prediction unit 182 includes a model that represents the physical and/or kinematic relationships between the various points or elements on the work vehicle 100. The prediction unit 182 operates to estimate a number of parameters, including the estimated base acceleration ($\widehat{a_b}$) and one or more estimated cylinder or link lengths ($\hat{p}$), ($\hat{y}$) (e.g., representing the estimated length of one or more of the pitch link (or cylinder) 146 and angle cylinder 144). The prediction unit 182 further generates an estimated joint orientation ($\hat{\theta}$) that represents an estimated current position of the ball joint 136.

The residual unit 184 receives estimated base acceleration ($\widehat{a_b}$) and estimated cylinder lengths ($\hat{p}$), ($\hat{y}$) from the prediction unit 182. The residual unit 184 further receives the measured base acceleration vector ($\vec{a}_b$) from the first IMU 150, the measured pitch link (or cylinder) length (p) from the pitch length sensor 166, and the measured angle cylinder length (y) from the angle cylinder sensor 164. The residual unit 184 generally operates to compare the estimated base acceleration ($\widehat{a_b}$) and estimated lengths ($\hat{p}$), ($\hat{y}$) to the measured base acceleration vector ($\vec{\omega}_b$) and the measured lengths (p), (y) in order to generate errors or residuals ($\Delta_r$). The residuals ($\Delta_r$) are provided to a solver unit 186.

The solver unit 186 receives the residuals ($\Delta_r$) and generates a change or correction in the joint orientation ($\Delta\theta$) based on the residuals ($\Delta_r$). In effect, the correction in joint orientation ($\Delta\theta$) represents the estimation of the joint orientation discussed below. The solver unit 186 may generate the joint orientation ($\Delta\theta$) in any suitable manner. In one example, the solver unit 186 may organize the subject parameters for consideration in a Jacobian matrix representing the partial derivatives of residuals with respect to joint orientations. In such an example, the solver unit 186 may multiply the inverse of such a Jacobian matrix by the residuals ($\Delta_r$) in order to yield the change in joint orientation ($\Delta\theta$). As described below, the solver unit 186 may solve for the change in joint orientation ($\Delta\theta$) in this manner using a Newton-Raphson method or approach. Moreover, the solver unit 186 may consider an attenuation value in the determination of the change in joint orientation ($\Delta\theta$). Generally, the attenuation value may be a value between zero (0) and one (1) that reflects the nature of the weight given to the acceleration values relative to angular velocity values (e.g., between the values generated by the accelerometers of the IMUs 150, 152 measuring the acceleration vectors ($\vec{a}_b$), ($\vec{a}_\iota$) and the values generated by the gyroscopes of the IMUs 150, 152 measuring the angular velocity vectors ($\vec{\omega}_b$), ($\vec{\omega}_\iota$)). Generally, the gyroscopes may be relatively accurate in the short term but have accumulated errors over time, whereas the accelerometers may be relatively "noisy" or inaccurate in the short term but relatively accurate in the long term. The attenuation value functions as a type of filter that indicates how much weight to give the acceleration vectors ($\vec{a}_b$), ($\vec{a}_\iota$) relative to the angular velocity vectors ($\vec{\omega}_b$), ($\vec{\omega}_\iota$). The attenuation value may be set by an operator (as indicated by the operator interface 138 of FIG. 3), while in other examples, the attenuation value may be set by designer and/or be calculated as a function of various operational parameters and/or sensor characteristics. In one example, the attenuation value may operate as a type of complimentary filter to appropriately consider the acceleration vectors ($\vec{a}_b$), ($\vec{a}_\iota$).

In some examples, the solver unit 186 may determine the joint orientation ($\Delta\theta$) according to a Kalman approach, which may be based on the nature of the sensor model (e.g., within the prediction unit 186) and an estimate of uncertainty.

Collectively, the prediction unit 182, the residual unit 184, and/or solver unit 186 operate to calculate the residuals ($\Delta_r$) based on each of the acceleration vectors ($\vec{a}_b$), ($\vec{a}_\iota$) and angular velocity vectors ($\vec{\omega}_b$), ($\vec{\omega}_\iota$). Upon resolving these parameters to a common point, estimates about the correction in joint orientation ($\Delta\theta$) may be generated. The sensors 164, 166 enable the consideration of the relative orientations of the IMUs 150, 152 about a vertical or mostly vertical axis, thereby enabling the sensor measurements to be fused with the measured parameters of the IMUs 150, 152, e.g., with a kinematic Newton-Raphson method or a Kalman filter method, as examples.

In any event, the solver unit 186 provides the joint orientation correction ($\Delta\theta$) to the adder unit 188, which also receives the estimated joint orientation ($\hat{\theta}$) from the prediction unit 182. The adder unit 188 determines the joint orientation ($\vec{\theta}$) from the joint orientation correction ($\Delta\theta$) and the estimated joint orientation ($\hat{\theta}$) (e.g., by summing the joint orientation correction ($\Delta\theta$) and the estimated joint orientation ($\hat{\theta}$)). As noted above, the current joint orientation ($\vec{\theta}$) may be provided to other portions of the controller 106 (e.g., the blade actuation system 174 of the machine control arrangement 106) for operation of the work vehicle 100.

Figure 4:
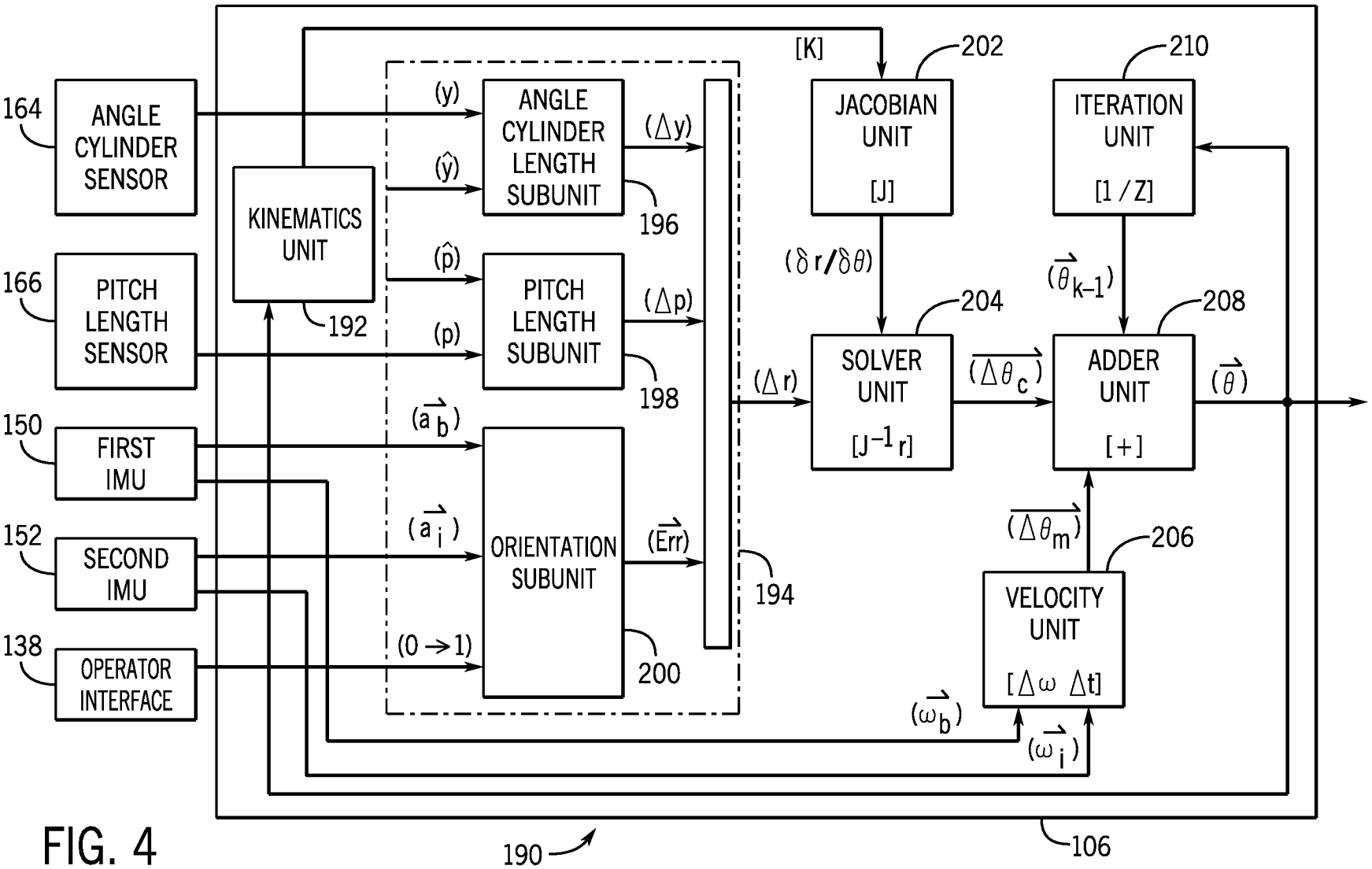
FIG. 4 is a schematic diagram with data flows of an implement joint orientation system of the machine control arrangement of FIG. 2 according to a further example embodiment.

Reference is now made to FIG. 4, which is a schematic block diagram of a further joint orientation system 190 that may be incorporated into the machine control arrangement 104 discussed above. The joint orientation system 190 may be considered a more detailed implementation or alternative to the joint orientation system 172 discussed above. Unless otherwise noted, the discussion above referencing the joint orientation system 172 is applicable to the joint orientation system 190 discussed below. As above, aspects of the joint orientation system 190 may be organized as one or more functional units or modules (and subunits) 192, 194, 196, 198, 200, 202, 204, 206, 208, 210 (e.g., software, hardware, or combinations thereof). As can be appreciated, the units and subunits 192, 194, 196, 198, 200, 202, 204, 206, 208, 210 shown in FIG. 4 may be combined and/or further partitioned to carry out similar functions to those described herein. In this example, the joint orientation system 190 may be considered to include a kinematics unit 192, a constraints unit 194, a Jacobian unit 202, a solver unit 204, a velocity unit 206, an adder unit 208, and an iteration unit 210. As described below, the joint orientation system 190 is configured to determine and solve a system of equations in order to generate the joint orientation ($\vec{\theta}$) based on the known fixed values (e.g., vectors with fixed magnitudes), the measured variable values (e.g., vectors with varying magnitudes that are measured), and the constraints on the system (e.g., certain vectors being fixed relative to one another). As will be understood by a person of ordinary skill in the art, the terms "solved," "solving," and "solution" as used herein are intended include an estimated solution. For example, the solution to the system of equations may include an estimated solution based on an iterative method that converges to a theoretical solution. Operation of the joint orientation system 190 will now be discussed in greater detail.

Generally, the kinematics unit 192 provides or generates the calculations or indications of the physical and/or kinematic relationships between the various points or elements on the work vehicle 100. For example, the kinematics unit 192 operates to calculate an estimated angle cylinder length ($\hat{y}$) as the point in space along one or more of the angle cylinders 144 supporting the blade 102 in between the relevant point on the blade 102 and the relevant point on the lift frame 134 based on the joint angle or orientation ($\vec{\theta}$) of joint 136 and the known location of those points with respect to the blade 102 and lift frame 134. The kinematics unit 192 may provide the angle cylinder length ($\hat{y}$) to the constraints unit 194 and may further provide one or more kinematic parameters (K) to the Jacobian unit 202.

The constraints (or residuals) unit 194 may operate to generate one or more constraints that bound the parameters or variables utilized by the joint orientation system 190 to determine the joint orientation ($\hat{\theta}$), particularly by generating the error correction of measured and estimated parameters in the form of residuals ($\Delta_r$). In one example, the constraints unit 194 may include or consider an orientation subunit 200, an angle cylinder length subunit 196, and a pitch length subunit 198.

Orientation subunit 200 receives a first acceleration vector ($\vec{a}_b$) from the first IMU 1150 (e.g., on the lift frame 134) and a second acceleration vector ($\vec{a}_\iota$) from the second IMU 152 (e.g., on the blade 102). In particular, the acceleration vectors ($\vec{a}_b$), ($\vec{a}_\iota$) are measured accelerations from the IMUs 150, 152. One or more of the acceleration vectors ($\vec{a}_b$), ($\vec{a}_\iota$) may be translated into a common coordinate frame and compared by the orientation subunit 200. The resulting difference between the acceleration vectors ($\vec{a}_b$), ($\vec{a}_\iota$) may be considered an orientation error ($\overrightarrow{Err}$) from one or both of the IMUs 150, 152. The orientation error ($\overrightarrow{Err}$) is provided to the solver unit 204 as part of the residuals ($\Delta_r$). Although not shown, in some examples, the orientation subunit 200 may also receive the change in residuals over the change in joint angle ($\overrightarrow{Err}$)from the Jacobian unit 202, which may be used to further determine or define the orientation error ($\overrightarrow{Err}$). As one example, at least a portion of the orientation error ($\overrightarrow{Err}$) may be refined in the direction of the tilt cylinder 142, while in another example, at least a portion of the orientation may be refined in the direction of the pitch link (or cylinder) 146.

In one example, an attenuation value may be received and considered by the orientation subunit 200 in the determination of the orientation error ($\overrightarrow{Err}$). Generally, the attenuation value may be a value between zero (0) and one (1) that reflects the nature of the weight given to the acceleration vectors ($\vec{a}_b$), ($\vec{a}_\iota$) relative to angular velocity vectors ($\vec{\omega}_b$), ($\vec{\omega}_\iota$). Generally, the angular velocity vectors ($\vec{\omega}_b$), ($\vec{\omega}_\iota$) may be relatively accurate in the short term but have accumulated errors over time, whereas the acceleration vectors ($\vec{\omega}_b$), ($\vec{\omega}_\iota$) may be relatively "noisy" or inaccurate in the short term but relatively accurate in the long term. The attenuation value functions as a type of filter that indicates how much weight to give the acceleration vectors ($\vec{a}_b$), ($\vec{a}_\iota$) (e.g., relative to the angular velocity vectors ($\vec{\omega}_b$), ($\vec{\omega}_\iota$), (i) subsequently considered). The attenuation value may be set by an operator (as indicated by the operator interface 138 of FIG. 4), while in other examples, the attenuation value may be set by designer and/or be calculated as a function of various operational parameters and/or sensor characteristics. In one example, the attenuation value may operate as a type of complimentary filter to appropriately consider the acceleration vectors ($\vec{a}_b$), ($\vec{a}_\iota$).

As noted above, the constraints unit 194 may also include an angle cylinder length subunit 196 that receives the measured angle cylinder length (y) from the angle cylinder sensor 164 and the estimated angle cylinder length ($\hat{y}$) from the kinematics unit 192. The angle cylinder length subunit 196 compares the measured angle cylinder length (y) and the estimated angle cylinder length ($\hat{y}$), and the difference is generated as a difference in angle cylinder length ($\Delta y$).

Further, the constraints unit 194 may also include a pitch length subunit 198 that receives the measured pitch link (or cylinder) length (p) from the pitch length sensor 166 and the estimated pitch link (or cylinder) length ($\hat{p}$) from the kinematics unit 180. The pitch length subunit 198 compares the measured pitch link (or cylinder) length (p) and the estimated pitch link (or cylinder) length ($\hat{p}$), and the difference is generated as a difference in pitch link (or cylinder) length ($\Delta p$). In some examples, the pitch length subunit 198 may be omitted such that the pitch link (or cylinder) length ($\Delta p$) may be omitted from as a constraint and/or the pitch link (or cylinder) length ($\Delta p$) may be estimated.

As such, one or both of the lengths of pitch link 146 and angle cylinder 144 are used as constraints as two-point members that connect the two portions of the work vehicle 100 associated with the IMUs 150, 152 (e.g., the blade 102 and the lift frame 134). If other connection points are present, those points may also be estimated and measured as constraints.

Collectively, orientation errors ($\overrightarrow{Err}$), the differences in angle cylinder length ($\Delta a$), and the differences in pitch link (or cylinder) length ($\Delta p$) may be considered residuals ($\Delta_r$) and organized into a vector, each row of which may be a constraint as the partial derivative (e.g., the rate of change)

of the respective residual or error ($\overrightarrow{Err}$) with respect to the three joint angles in order to facilitate calculation of the joint orientation ($\vec{\theta}$), discussed below.

Generally, the Jacobian unit 202 provides information associated with various kinematic relationships between the joint 136 and the various points of measurement to facilitate the determination of the state of the joint 136. In one example, the Jacobian unit 3202 provides a mechanism for expressing the relationship between the rate of change of the residuals ($\Delta_r$) with respect to the joint orientation ($\vec{\theta}$). As noted above, the Jacobian unit 202 enables, based on the kinematic parameters from the kinematics unit 192, the determination of how much the constraints (e.g., residuals ($\Delta_r$)) change if the joint orientation ($\theta$) changes. In effect, the Jacobian unit 202 generates and outputs the change in residuals over the change in joint orientation ($\partial r/\partial\theta$).

The solver unit 204 receives the residuals ($\Delta_r$) from the constraints unit 194 and the change in residuals over the change in joint orientation ($\partial r/\partial\theta$) from the Jacobian unit 202. The solver unit 204 multiples the inverse of the change in residuals over the change in joint orientation ($\partial r/\partial\theta$) by the residuals ($\Delta_r$) to yield a joint orientation (or angle) correction ($\Delta\theta_c$). As introduced above, the residuals ($\Delta_r$) generally reflect the nature of the errors, and with the change in residuals over the change in joint orientation ($\partial r/\partial\theta$), provides an indication of how much the errors change if the angle values change, thereby providing a mechanism to reduce and eliminate errors in the determination of the joint orientation, e.g., reflected in the joint orientation correction ($\Delta\theta_c$). The solver unit 204 provides the joint orientation correction ($\Delta\theta_c$) to the adder unit 208.

The velocity unit 206 receives first angular velocity vector ($\vec{\omega}_b$) from the first IMU 150 (e.g., on the lift frame 134) and the second angular velocity vector ($\vec{\omega}_l$) from the second IMU 152 (e.g., on the blade 102). Each angular velocity vector ($\vec{\omega}_b$), ($\vec{\omega}_l$) may be modified as necessary to reflect a common frame of reference, such relative to earth or a first body (e.g., the lift frame 134) frame of reference, based a reference physical relationship between the two IMUs 150, 152. In one example, the second angular velocity vector ($\vec{\omega}_l$) may be multiplied by an implement rotation matrix representing the physical relationship between the blade 102 and the lift frame 134 such that the second angular velocity vector ($\vec{\omega}_l$) is expressed in the same coordinate system as the first angular velocity vector ($\vec{\omega}_b$). The velocity unit 206 considers the velocity vectors ($\vec{\omega}_b$), ($\vec{\omega}_l$) with respect to a particular time step or period ($\Delta_t$) such that the difference between the first and second angular velocities ($\Delta\omega$) over the time period ($\Delta_t$) yields a measured change in joint orientation ($\overrightarrow{\Delta\theta_m}$) based on relative joint angular velocity.

As above, collectively, the constraints unit 194, the Jacobian unit 202, the solver unit 204, and the velocity unit 206 operate to calculate the corrections, gains, or modifications (e.g., the joint orientation correction ($\Delta\theta_c$) and/or measured change in joint orientation ($\overrightarrow{\Delta\theta_m}$)) based on the angular velocity vector ($\vec{\omega}_b$) and acceleration vector ($\vec{a}_b$) of the first IMU 150 and the angular velocity ($\vec{\omega}_l$) and acceleration vector ($\vec{a}_l$). at the second IMU 152. As noted below, these corrections are applied to an estimate of joint orientation to generate the current joint orientation ($\vec{\theta}$).

The adder unit 208 receives the measured change in joint angular velocity ($\overrightarrow{\Delta\theta_m}$) from the velocity unit 206 and the joint orientation correction ($\Delta\theta_c$) from the solver unit 204. The adder unit 208 also receives the previous orientation vector ($\overrightarrow{\Delta\theta_{k-1}}$) from a delay or iteration unit 210. Generally, the iteration unit 210 receives and holds the vector of the current orientation ($\vec{\theta}$) to subsequently provide as a previous orientation ($\overrightarrow{\Delta\theta_{k-1}}$) to the adder unit 208. The previous orientation ($\overrightarrow{\Delta\theta_{k-1}}$) may function as an estimate of the current orientation.

The adder unit 208 adds the measured change in joint angular velocity ($\overrightarrow{\Delta\theta_m}$) and the joint orientation correction ($\Delta\theta_c$) to the previous orientation ($\overrightarrow{\Delta\theta_{k-1}}$) in order to generate a current joint orientation ($\vec{\theta}$). As noted above, the current joint orientation ($\vec{\theta}$) may be provided to other portions of the controller 106 (e.g., the blade actuation system 174 of the machine control arrangement 106) for operation of the work vehicle 100.

Generally, referring to each of FIGS. 3 and 4, the iterative nature of the joint orientations systems 172, 190 may function as a complimentary filter, Kalman filter, or a Newton-Raphson method to improve the determination of the current orientation ($\vec{\theta}$). Generally, the Newton-Raphson method is a root-finding algorithm that produces successively better approximations of the roots of a function. For example, the method has an initial guess of the zero of the function, and the slope (e.g., as may be represented as ($\Delta r/\Delta x$)) is calculated at that point to determine the error and the associated projection of a corresponding value to eliminate that error. This mechanism is repeated to reduce the error of time to improve approximations of the resulting current joint orientation ($\vec{\theta}$). In effect, the Newton-Raphson method may be used to solve the systems of equations within the joint orientations systems 172, 190. In particular, the joint orientations systems 172, 174 may utilize the rate of change relationship between the constraints and the orientation angles to calculate the amount the respective angle needs to change in order to close the residual errors. As one example, the Newton-Raphson method may be implemented by the joint orientations systems 172, 190 to calculate the joint orientation correction ($\Delta\theta_c$), while in other examples, a Kalman technique may be used. Along with the evaluation of changes in joint angular velocity, the joint orientations systems 172, 174 may use these corrections or gains to generate a current orientation vector representing the joint orientation ($\vec{\theta}$).

In effect, each of the joint orientation systems 172, 190 operate to calculate one or more values (e.g., accelerations) at a common point (e.g., at the joint 136) based on first IMU measurements of acceleration and angular velocity and also based on second IMU measurements of acceleration and angular velocity. Dynamically (and statically), either of the two mechanisms for calculating the values at the common point should be identical. As such, the joint orientation systems 172, 190 may use any differences in the values to determine an estimate of error at the common point (e.g., at the joint 136), thereby enabling a more accurate determination of the joint orientation. This may be in contrast to other systems in which only acceleration measurements are considered, even when the elements are in motion.

Although the machine control arrangement 104 and the joint orientation systems 172, 190 are discussed above with respect to the blade 102 as the implement, the embodiments discussed herein may also apply to other types of implements. Moreover, the machine control arrangement 104 may apply the principles of the embodiments discussed herein to any two elements of the work vehicle 100 that have relative movement (e.g., a joint between two portions of the vehicle frame).

The machine control arrangement and/or joint orientation system discussed herein may further be embodied as a method for a work vehicle. In particular, the method includes collecting, with a first inertial measurement unit (IMU) coupled to the chassis or lift frame, a first acceleration and a first angular velocity of the chassis or lift frame; collecting, with a second IMU coupled to the implement, a second acceleration and a second angular velocity of the implement; determining, with a controller, a joint orientation correction based the first acceleration, first angular velocity, the second acceleration, and second angular velocity; modifying, with the controller, an estimate of joint orientation with the joint angle correction to generate a current joint orientation of the joint; and actuating the implement based on the current joint orientation. Additional steps may include collecting, with a first cylinder sensor associated with a first cylinder extending between the chassis and the implement, a first cylinder length associated with the first cylinder; collecting, with a second cylinder sensor associated with a second cylinder extending between the chassis and the implement, a second cylinder length associated with the second cylinder; and generating the joint angle correction additionally with the first cylinder length and the second cylinder length as constraints on the joint angle correction. Further steps may include generating, with the controller, residuals based on the first acceleration, the second acceleration, the first cylinder length, and the second cylinder length; generating, with the controller, a Jacobian matrix based a kinematic relationship between the joint, the first IMU, and the second IMU; and generating the joint angle correction based on the residuals and the Jacobian matrix. Further steps may include attenuating, with the controller, the orientation error based on characteristics of the first IMU and the second IMU; and/or generating the joint angle correction includes generating the joint angle correction based on a Newton-Raphson method. Further method steps may be embodied and expressed as the system functions and operations discussed above.

Accordingly, the present disclosure provides a joint orientation system and method for a work vehicle. Such systems and methods provide improved and more efficient operation.

Also, the following examples are provided, which are numbered for easier reference.

1. A joint orientation system for a work vehicle having a chassis and an implement coupled to the chassis at a joint, the joint orientation system comprising: a first inertial measurement unit (IMU) positioned on a first side of the work vehicle relative to the joint and configured to collect a first IMU acceleration and a first IMU angular velocity; a second IMU positioned on a second side of the work vehicle relative to the joint and configured to collect a second IMU acceleration and a second IMU angular velocity; and a controller coupled to the first IMU and the second IMU, the controller having a processor and memory architecture configured to: receive the first IMU acceleration, the first IMU angular velocity, the second IMU acceleration, and the second IMU angular velocity; determine a joint orientation correction based the first IMU acceleration, the first IMU angular velocity, the second IMU acceleration, and the second IMU angular velocity; modify an estimate of joint orientation with the joint orientation correction to generate a current joint orientation of the joint; and output the current joint orientation of the joint for actuation of the implement.

2. The joint orientation system of example 1, further comprising: a first sensor associated with a first cylinder or link extending between the chassis and the implement and configured to collect a first length associated with the first cylinder or link, and wherein the controller is further configured to generate the joint orientation correction additionally with the first length as a constraint on the joint orientation correction.

3. The joint orientation system of example 2, further comprising: a second cylinder sensor associated with a second cylinder or link extending between the chassis and the implement and configured to collect a second length associated with the second cylinder or link, and wherein the controller is further configured to generate the joint orientation correction additionally with the second length as an additional constraint on the joint orientation correction.

4. The joint orientation system of example 3, wherein the first sensor is a pitch length sensor and the first cylinder or link is a pitch cylinder or link; and wherein the second cylinder sensor is an angle cylinder sensor and the second cylinder is an angle cylinder.

5. The joint orientation system of example 4, wherein the controller is further configured to: generate residuals based on the first IMU acceleration, the second IMU acceleration, the first length, and the second length; generate a Jacobian matrix based a kinematic relationship between the joint, the first IMU, and the second IMU; and generate the joint orientation correction based on the residuals and the Jacobian matrix.

6. The joint orientation system of example 5, wherein the controller is further configured to attenuate the joint orientation correction based on characteristics of the first IMU and the second IMU.

7. The joint orientation system of example 5, wherein the controller is further configured to generate the joint angle correction based on a Newton-Raphson method.

8. The joint orientation system of example 1, wherein the controller is further configured to: determine a difference in the first IMU angular velocity and the second IMU angular velocity to generate a joint angular velocity; estimate a first estimated acceleration based on the joint angular velocity and the second IMU acceleration; and generate the joint orientation correction based on the first estimated acceleration and the first IMU acceleration.

9. The joint orientation system of example 1, wherein the controller is further configured to: determine an orientation error based on a difference between the first IMU acceleration and the second IMU acceleration; generate a relative joint angular velocity from the first IMU angular velocity and the second IMU angular velocity; and modify the estimate of the joint orientation based on the orientation error and the relative joint angular velocity as the joint orientation correction.

10. A work vehicle, comprising: a chassis; a lift frame supported by the chassis; an implement coupled to the lift frame at a joint; at least one cylinder pivotably coupled to the implement and the chassis or the lift frame such that actuation of the at least one cylinder repositions the implement relative to at least one of the chassis and the lift frame at the joint; and a machine control arrangement comprising: a first inertial measurement unit (IMU) coupled to the chassis or the lift frame and configured to collect a first IMU acceleration and a first IMU angular velocity of the chassis or the lift frame; a second IMU coupled to the implement and configured to collect a second IMU acceleration and a second IMU angular velocity of the implement; a joint orientation system coupled to the first IMU and the second IMU and having processing and memory architecture configured to: receive the first IMU acceleration, the first IMU angular velocity, the second IMU acceleration, and the second IMU angular velocity; determine a joint orientation correction based on the first IMU acceleration, the first IMU angular velocity, the second IMU acceleration, and the second IMU angular velocity; and modify an estimate of joint orientation with the joint orientation correction to generate a current joint orientation of the joint; and an implement actuation system coupled to the joint orientation system and the at least one cylinder and having processing and memory architecture configured to: receive operator commands from an operator and the current joint orientation from the joint orientation system; and actuate the at least one cylinder based on the current joint orientation and the operator commands.

11. The work vehicle of example 10, wherein the at least one cylinder includes a first cylinder extending between the chassis and the implement; wherein the machine control arrangement further comprises a first sensor configured to collect a first length associated with the first cylinder; and wherein the joint orientation system is further configured to generate the joint orientation correction additionally with the first length as a constraint on the joint orientation correction.

12. The work vehicle of example 11, further comprising: at least one additional cylinder or link extending between the chassis and the implement; wherein the machine control arrangement further comprises a second sensor configured to collect a second length associated with the additional cylinder or link; and wherein the joint orientation system is further configured to generate the joint orientation correction additionally with the second length as an additional constraint on the joint orientation correction.

13. The work vehicle of example 12, wherein the first sensor is an angle cylinder sensor and the first cylinder is an angle cylinder; and wherein the second sensor is a pitch length sensor and the second cylinder or link is a pitch cylinder or link.

14. The work vehicle of example 13, wherein the joint orientation system is further configured to: generate residuals based on the first IMU acceleration, the second IMU acceleration, the first length, and the second length; and generate a Jacobian matrix based a kinematic relationship between the joint, the first IMU, and the second IMU; and generate the joint orientation correction based on the residuals and the Jacobian matrix.

15. The work vehicle of example 14, wherein the joint orientation system is further configured to attenuate the joint orientation correction based on characteristics of the first IMU and the second IMU.

Embodiments of the present disclosure may be described herein in terms of functional and/or logical block components and various processing steps. It should be appreciated that such block components may be realized by any number of hardware, software, and/or firmware components configured to perform the specified functions. For example, an embodiment of the present disclosure may employ various integrated circuit components, e.g., memory elements, digital signal processing elements, logic elements, look-up tables, or the like, which may carry out a variety of functions under the control of one or more microprocessors or other control devices. In addition, those skilled in the art will appreciate that embodiments of the present disclosure may be practiced in conjunction with any number of systems, and that the work vehicles and the control systems and methods described herein are merely exemplary embodiments of the present disclosure.

Conventional techniques related to signal processing, data transmission, signaling, control, and other functional aspects of the systems (and the individual operating components of the systems) may not be described in detail herein for brevity. Furthermore, the connecting lines shown in the various figures contained herein are intended to represent example functional relationships and/or physical couplings between the various elements. It should be noted that many alternative or additional functional relationships or physical connections may be present in an embodiment of the present disclosure.

As will be appreciated by one skilled in the art, certain aspects of the disclosed subject matter may be embodied as a method, system (e.g., a work vehicle control system included in a work vehicle), or computer program product. Accordingly, certain embodiments may be implemented entirely as hardware, entirely as software (including firmware, resident software, micro-code, etc.) or as a combination of software and hardware (and other) aspects. Furthermore, certain embodiments may take the form of a computer program product on a computer-usable storage medium having computer-usable program code embodied in the medium. As such, it should be noted that a plurality of hardware and software based devices, as well as a plurality of different structural components may be utilized to implement the described embodiments. For example, "controller" and "control unit" described in the specification may include one or more electronic processors, one or more memory modules including non-transitory computer-readable medium, one or more input/output interfaces, and various connections (for example, a system bus) connecting the components.

Any suitable computer usable or computer readable medium may be utilized. The computer usable medium may be a computer readable signal medium or a computer readable storage medium. A computer-usable, or computer-readable, storage medium (including a storage device associated with a computing device or client electronic device) may be, for example, but is not limited to, an electronic, magnetic, optical, electromagnetic, infrared, or semiconductor system, apparatus, or device, or any suitable combination of the foregoing. More specific examples (a non-exhaustive list) of the computer-readable medium would include the following: an electrical connection having one or more wires, a portable computer diskette, a hard disk, a random access memory (RAM), a read-only memory (ROM), an erasable programmable read-only memory (EPROM or Flash memory), an optical fiber, a portable compact disc read-only memory (CD-ROM), an optical storage device. In the context of this document, a computer-usable, or computer-readable, storage medium may be any tangible medium that may contain, or store a program for use by or in connection with the instruction execution system, apparatus, or device. A computer readable signal medium may include a propagated data signal with computer readable program code embodied therein, for example, in baseband or as part of a carrier wave. Such a propagated signal may take any of a variety of forms, including, but not limited to, electro-magnetic, optical, or any suitable combination thereof. A computer readable signal medium may be non-transitory and may be any computer readable medium that is not a computer readable storage medium and that may communicate, propagate, or transport a program for use by or in connection with an instruction execution system, apparatus, or device.

Aspects of certain embodiments are described herein may be described with reference to flowchart illustrations and/or block diagrams of methods, apparatus (systems) and computer program products according to embodiments of the invention. It will be understood that each block of any such flowchart illustrations and/or block diagrams, and combinations of blocks in such flowchart illustrations and/or block diagrams, may be implemented by computer program instructions. These computer program instructions may be provided to a processor of a general purpose computer, special purpose computer, or other programmable data processing apparatus to produce a machine, such that the instructions, which execute via the processor of the computer or other programmable data processing apparatus, create means for implementing the functions/acts specified in the flowchart and/or block diagram block or blocks.

The terminology used herein is for the purpose of describing particular embodiments only and is not intended to be limiting of the disclosure. As used herein, the singular forms "a", "an" and "the" are intended to include the plural forms as well, unless the context clearly indicates otherwise. It will be further understood that the terms "comprises" and/or "comprising," when used in this specification, specify the presence of stated features, integers, steps, operations, elements, and/or components, but do not preclude the presence or addition of one or more other features, integers, steps, operations, elements, components, and/or groups thereof. As used herein, unless otherwise limited or modified, lists with elements that are separated by conjunctive terms (e.g., "and") and that are also preceded by the phrase "one or more of" or "at least one of" indicate configurations or arrangements that potentially include individual elements of the list, or any combination thereof. For example, "at least one of A, B, and C" or "one or more of A, B, and C" indicates the possibilities of only A, only B, only C, or any combination of two or more of A, B, and C (e.g., A and B; B and C; A and C; or A, B, and C).

It is to be understood that the disclosure is not limited in its application to the details of construction and the arrangement of components set forth in the following description or illustrated in the following drawings. The disclosure is capable of supporting other embodiments and of being practiced or of being carried out in various ways. Also, it is to be understood that the phraseology and terminology used herein is for the purpose of description and should not be regarded as limiting. The use of "including," "comprising," or "having" and variations thereof herein is meant to encompass the items listed thereafter and equivalents thereof as well as additional items. Unless specified or limited otherwise, the terms "mounted," "connected," "supported," and "coupled" and variations thereof are used broadly and encompass both direct and indirect mountings, connections, supports, and couplings. Further, "connected" and "coupled" are not restricted to physical or mechanical connections or couplings. Terms of degree, such as "substantially," "about," "approximately," etc. are understood by those of ordinary skill to refer to reasonable ranges outside of the given value, for example, general tolerances associated with manufacturing, assembly, and use of the described embodiments.

The description of the present disclosure has been presented for purposes of illustration and description, but is not intended to be exhaustive or limited to the disclosure in the form disclosed. Many modifications and variations will be apparent to those of ordinary skill in the art without departing from the scope and spirit of the disclosure. Explicitly referenced embodiments herein were chosen and described in order to best explain the principles of the disclosure and their practical application, and to enable others of ordinary skill in the art to understand the disclosure and recognize many alternatives, modifications, and variations on the described example(s). Accordingly, various embodiments and implementations other than those explicitly described are within the scope of the following claims.

What is claimed is:

1. A joint orientation system for a work vehicle having a chassis and an implement coupled to the chassis at a ball joint, the joint orientation system comprising:

a first inertial measurement unit (IMU) positioned on a first side of the work vehicle relative to the ball joint and configured to collect a first IMU acceleration and a first IMU angular velocity;

a second IMU positioned on a second side of the work vehicle relative to the ball joint and configured to collect a second IMU acceleration and a second IMU angular velocity;

a pitch length sensor associated with a pitch cylinder or link extending between the chassis and the implement and configured to collect a first length associated with the pitch cylinder or link;

an angle sensor associated with an angle cylinder or link extending between the chassis and the implement and configured to collect a second length associated with the angle cylinder or link; and a controller coupled to the first IMU and the second IMU, the controller having a processor and memory architecture configured to:

receive the first IMU acceleration, the first IMU angular velocity, the second IMU acceleration, and the second IMU angular velocity;

determine a joint orientation correction based the first IMU acceleration, the first IMU angular velocity, the second IMU acceleration, and the second IMU angular velocity and with the first length and the second length as constraints on the joint orientation correction;

modify an estimate of joint orientation with the joint orientation correction to generate a current joint orientation of the ball joint; and output the current joint orientation of the ball joint for actuation of the implement.

2. The joint orientation system of claim 1, wherein the controller is further configured to:

generate residuals based on the first IMU acceleration, the second IMU acceleration, the first length, and the second length;

generate a Jacobian matrix based on a kinematic relationship between the ball joint, the first IMU, and the second IMU; and generate the joint orientation correction based on the residuals and the Jacobian matrix.

3. The joint orientation system of claim 2, wherein the controller is further configured to attenuate the joint orientation correction based on characteristics of the first IMU and the second IMU.

4. The joint orientation system of claim 2, wherein the controller is further configured to generate the joint angle correction based on a Newton-Raphson method.

5. The joint orientation system of claim 1, wherein the controller is further configured to:

determine a difference in the first IMU angular velocity and the second IMU angular velocity to generate a joint angular velocity;

estimate a first estimated acceleration based on the joint angular velocity and the second IMU acceleration; and generate the joint orientation correction based on the first estimated acceleration and the first IMU acceleration.

6. The joint orientation system of claim 1, wherein the controller is further configured to:

determine an orientation error based on a difference between the first IMU acceleration and the second IMU acceleration;

generate a relative joint angular velocity from the first IMU angular velocity and the second IMU angular velocity; and modify the estimate of the joint orientation based on the orientation error and the relative joint angular velocity as the joint orientation correction.

7. A work vehicle, comprising:

a chassis;

a lift frame supported by the chassis;

an implement coupled to the lift frame at a ball joint;

a pitch cylinder and an angle cylinder pivotably coupled to the implement and the chassis or the lift frame such that actuation of the pitch cylinder and the angle cylinder repositions the implement relative to the chassis or the lift frame at the ball joint; and a machine control arrangement comprising:

a first inertial measurement unit (IMU) coupled to the chassis or the lift frame and configured to collect a first IMU acceleration and a first IMU angular velocity of the chassis or the lift frame;

a second IMU coupled to the implement and configured to collect a second IMU acceleration and a second IMU angular velocity of the implement;

a pitch length sensor associated with the pitch cylinder and configured to collect a first length associated with the pitch cylinder; and an angle sensor associated with the angle cylinder and configured to collect a second length associated with the angle cylinder;

a joint orientation system coupled to the first IMU and the second IMU and having processing and memory architecture configured to:

receive the first IMU acceleration, the first IMU angular velocity, the second IMU acceleration, and the second IMU angular velocity;

determine a joint orientation correction based on the first IMU acceleration, the first IMU angular velocity, the second IMU acceleration, and the second IMU angular velocity and with the first length and the second length as constraints on the joint orientation correction; and modify an estimate of joint orientation with the joint orientation correction to generate a current joint orientation of the ball joint; and an implement actuation system coupled to the joint orientation system and the at least one cylinder and having processing and memory architecture configured to:

receive operator commands from an operator and the current joint orientation from the joint orientation system; and actuate the at least one cylinder based on the current joint orientation and the operator commands.

8. The work vehicle of claim 7, wherein the joint orientation system is further configured to:

generate residuals based on the first IMU acceleration, the second IMU acceleration, the first length, and the second length; and generate a Jacobian matrix based on a kinematic relationship between the joint, the first IMU, and the second IMU; and generate the joint orientation correction based on the residuals and the Jacobian matrix.

9. The work vehicle of claim 8, wherein the joint orientation system is further configured to attenuate the joint orientation correction based on characteristics of the first IMU and the second IMU.

10. The work vehicle of claim 8, wherein the joint orientation system is further configured to generate the joint orientation correction based on a Newton-Raphson method.

11. The work vehicle of claim 7, wherein the implement is a blade.

12. The work vehicle of claim 7, wherein the joint orientation system is further configured to:

determine a difference in the first IMU angular velocity and the second IMU angular velocity to generate a joint angular velocity;

estimate a first estimated acceleration based on the joint angular velocity and the second IMU acceleration; and generate the joint orientation correction based on the first estimated acceleration and the first IMU acceleration.

13. A method of operating an implement of a work vehicle extending from a chassis of the work vehicle at a ball joint, the method comprising:

collecting, with a first inertial measurement unit (IMU) positioned on a first side of the work vehicle relative to the ball joint, a first IMU acceleration and a first IMU angular velocity;

collecting, with a second IMU positioned on a second side of the work vehicle relative to the ball joint, a second IMU acceleration and a second IMU angular velocity;

collecting, with a pitch length sensor associated with a pitch cylinder, a first length associated with the pitch cylinder; and collecting, with an angle sensor associated with an angle cylinder, a second length associated with the angle cylinder;

determining, with a controller, a joint orientation correction based on the first IMU acceleration, the first IMU angular velocity, the second IMU acceleration, and the second IMU angular velocity and with the first length and the second length as constraints on the joint orientation correction;

modifying, with the controller, an estimate of joint orientation with the joint orientation correction to generate a current joint orientation of the ball joint; and actuating the implement based on the current joint orientation.

* * * * *